US005215227A

United States Patent [19]

Farner

[11] Patent Number: 5,215,227

[45] Date of Patent: Jun. 1, 1993

[54] ASSAILANT MARKER

[76] Inventor: Norbert A. Farner, 1015 Jolls Rd., Perrysburg, N.Y. 14129

[21] Appl. No.: 911,497

[22] Filed: Jul. 10, 1992

[51] Int. Cl.[5] ..... B67D 5/32; B67D 83/00

[52] U.S. Cl. ..... 222/175; 222/321; 222/382; 222/464

[58] Field of Search ..... 222/320, 321, 78, 175, 222/378, 382, 464, 402.13

[56] References Cited

U.S. PATENT DOCUMENTS

| | | | |
|---|---|---|---|
| 1,514,107 | 11/1924 | Schutten | 222/378 X |
| 1,641,003 | 8/1927 | Lang | 222/378 X |
| 1,646,687 | 10/1927 | Daly . | |
| 2,011,196 | 8/1935 | Moody . | |
| 2,081,798 | 5/1937 | Dinneen . | |
| 2,083,058 | 6/1937 | De Weal | 222/378 X |
| 3,450,313 | 6/1969 | Jonas | 222/175 X |
| 4,241,850 | 12/1980 | Speer | 222/78 X |
| 4,275,820 | 6/1981 | LeBlond | 222/175 X |
| 4,434,914 | 3/1984 | Meshberg | 222/402.13 X |
| 4,550,861 | 11/1985 | Fay, Sr. et al. | 222/78 |
| 4,610,806 | 9/1986 | Rosen . | |
| 4,728,037 | 3/1988 | Mainhardt . | |
| 4,848,246 | 7/1989 | Rosen . | |
| 4,944,429 | 7/1990 | Bishop et al. | 222/321 X |
| 5,088,624 | 2/1992 | Hackett et al. | 222/78 |
| 5,111,968 | 5/1992 | Wilkerson | 222/175 X |

FOREIGN PATENT DOCUMENTS

| | | | |
|---|---|---|---|
| 2637975 | 3/1978 | Fed. Rep. of Germany | 222/464 |
| 2641480 | 7/1990 | France | 222/382 |
| 674076 | 4/1990 | Switzerland | 222/175 |

*Primary Examiner*—Kevin P. Shaver
*Attorney, Agent, or Firm*—Richard C. Litman

[57] ABSTRACT

A marking device for spraying a liquid food-grade dye mixture onto a potential assailant. The device includes a spray pump for use in connection with a bottle or other portable container for dispensing said mixture therefrom. The manually activated fluid dispensing means provide thereto a closure and when actuated with a reciprocatory movement will pump the contents from the bottle and dispense said contents in spray form. To facilitate the activation of the pump and to prevent unauthorized removal of the marking device from the hand of the user, finger retaining loops are provided. The pump is supported solely from the neck of the bottle or other container with which it is associated, and, hence, independently of the walls of the bottle so that the contour of such walls can be disregarded.

5 Claims, 2 Drawing Sheets

34
32
16
30
26
28
30
20
18
22
24
24a
13
12
12d
12e
12b
12c

ASSAILANT MARKER

FIELD OF THE INVENTION

The present invention relates generally to indicating devices for deterring crime. In particular, a pump sprayer having a mixture of non-toxic dyes therein for marking an assailant under circumstances indicating imminent attack is disclosed.

BACKGROUND OF THE INVENTION

Attempts have been undertaken to develop effective personal self-defense devices for untrained individuals believing that such protection is necessary. Tear gas cartridges, sold under the trademark MACE, have become commonplace in our society, and may be purchased at hardware and drug stores in many jurisdictions. Additionally, lesser known devices employing tear gas substitutes such as ammonia or red pepper have been invented. Although these particular devices are purported to be effective in deterring crime directed toward an individual, including: robbery, rape, mayhem, kidnapping, and murder, the crime rate continues to soar.

In the District of Columbia alone this past year, over four hundred murders occurred. It has been reported that in only fifty percent of the murder cases investigated by District police were arrests of a suspect made, and in approximately fifty percent of the cases where an arrest was made were criminal convictions obtained and the guilty party sent to prison. It can be seen that even if the collective criminal justice systems for the remaining portion of the United States functioned with twice the efficiency in obtaining criminal convictions as that of the District of Columbia, clearly only a fraction of those individuals committing serious crime are being removed from society as a punishment for their criminal actions.

A major problem faced by prosecutors in obtaining convictions is the fact that the victim is usually the only witness to the crime and physical evidence establishing the presence of the defendant at the crime scene is often minimal at best. It has been found to be highly advantageous to have a self-defense device capable of assisting police and witnesses in identifying a criminal assailant at a later time. Tear gas does irritate the skin somewhat, causing a minimal skin reddening effect, but the effect is not long lasting and varies between individuals. Self-defense devices which include dyes, however, can be helpful in permitting authorities to identify the assailant, particularly if captured recently after the attack.

Personal self-defense devices containing tear gas and other lachrymal agents are likely to escalate many encounters. It is not improbable that unskilled users will incorrectly deploy the device and miss, or only partially strike, their assailant. The assailant then, in retaliation or self-defense, may choose to utilize a weapon such as a gun against original victim rather than flee as intended. Additionally, such devices lack retaining means for preventing their unauthorized removal from the victim's person as with a sharp blow. Under such circumstances, it is possible that the device could come within the possession of the attacker and who may utilize such to incapacitate the original user.

A self-defense device utilizing a non-toxic dye agent is believed to afford the optimum protection to a potential attack victim. Accuracy of aim is not critical with such a device as any contact of the colored spray will mark the potential assailant for later identification. When sprayed onto an assailant's body or clothing, many dying agents deposit a stain that cannot be removed without repeated washing. Furthermore, devices containing only dye agents are unlikely to cause serious bodily injury to small children who happen to encounter such when unattended unlike devices containing lachrymal agents, odor agents, and the like.

DESCRIPTION OF THE RELATED ART

Containers for the dispensing of crime deterring fluids are known in the prior art, but they have not been employed or constructed to facilitate the contact of the fluid with an assailant and prevent the unauthorized removal of the device from the possession of the user. Moreover, the prior art devices often include complicated triggering or nozzle structures, and agents likely to escalate a criminal encounter.

U.S. Pat. No. 1,646,687, issued Oct. 25, 1927 to Thomas Daly, discloses an indicating device adapted to be employed in a valise for the prevention and detection of the theft of negotiable instruments and other documents. The device comprises an outer casing for receiving a discoloring material, such as a colored liquid dye, and an inner casing for receiving a suitable explosive. The explosive is electrically fired when unauthorized attempts are made to open the valise.

U.S. Pat. No. 4,610,806, issued Sep. 9, 1986 to Gerald M. Rosen, shows a skin-marking compound which reacts with proteins in the epidermis to form a reaction product which is invisible in ordinary light but fluoresces under ultraviolet light. Additionally, a dyestuff or pigment may be added to the skin-marking compound to render such visible in ordinary light. A conventional marking pen is used to apply the compound to the skin.

U.S. Pat. No. 4,728,037, issued Mar. 1, 1988 to Robert Mainhardt, provides a self-defense device including a resilient squeeze bottle having a non-toxic deterrent fluid mixture therein. A sealing substance placed within the nozzle prevents fluid leakage therefrom prior to use. The deterrent mixture includes: a surfactant lachrymal agent, a food-grade dye and an odor agent.

U.S. Pat. No. 4,848,246, issued Jul. 18, 1989 to Leon Rosen, describes a glove worn upon the hand of a "victim" including plural color applicators located on the respective finger tips of the glove. When used, each applicator applies a respectively colored dye which supplied via conduit from a reservoir located at the palm or microencapsulated in beads on the glove's finger tips.

None of the above inventions and patents, taken either singly or in combination, is seen to describe the instant invention as claimed.

SUMMARY OF THE INVENTION

Accordingly, it is a principal object of the invention to provide a self-defense device including a pump spray bottle having a non-toxic dye mixture therein for marking an assailant under circumstances indicating imminent attack.

Additionally, it is an object of the invention to provide a self-defense device which may not be easily removed from the possession of the user without assent to such an action.

It is a final object of the invention to provide improved elements and arrangements in a self-defense device for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently thoughout the attached drawings.

DETAILED DESCRIPTION OF THE PREFERRED EMBODIMENT

Figure 1:
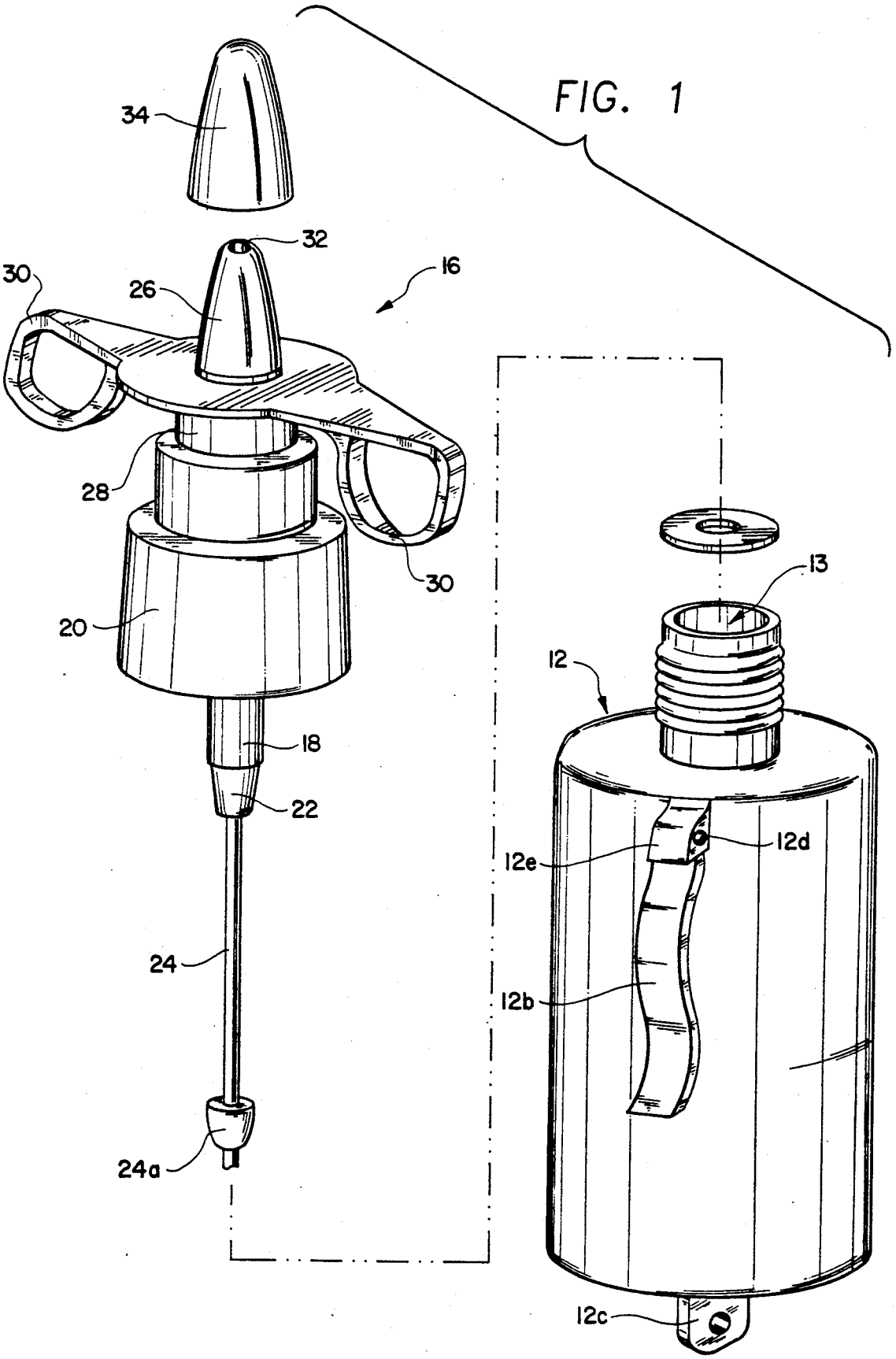
FIG. 1 is a perspective view of an assailant marker constructed in accordance with this invention and partially disassembled for inspection.
Figure 2:
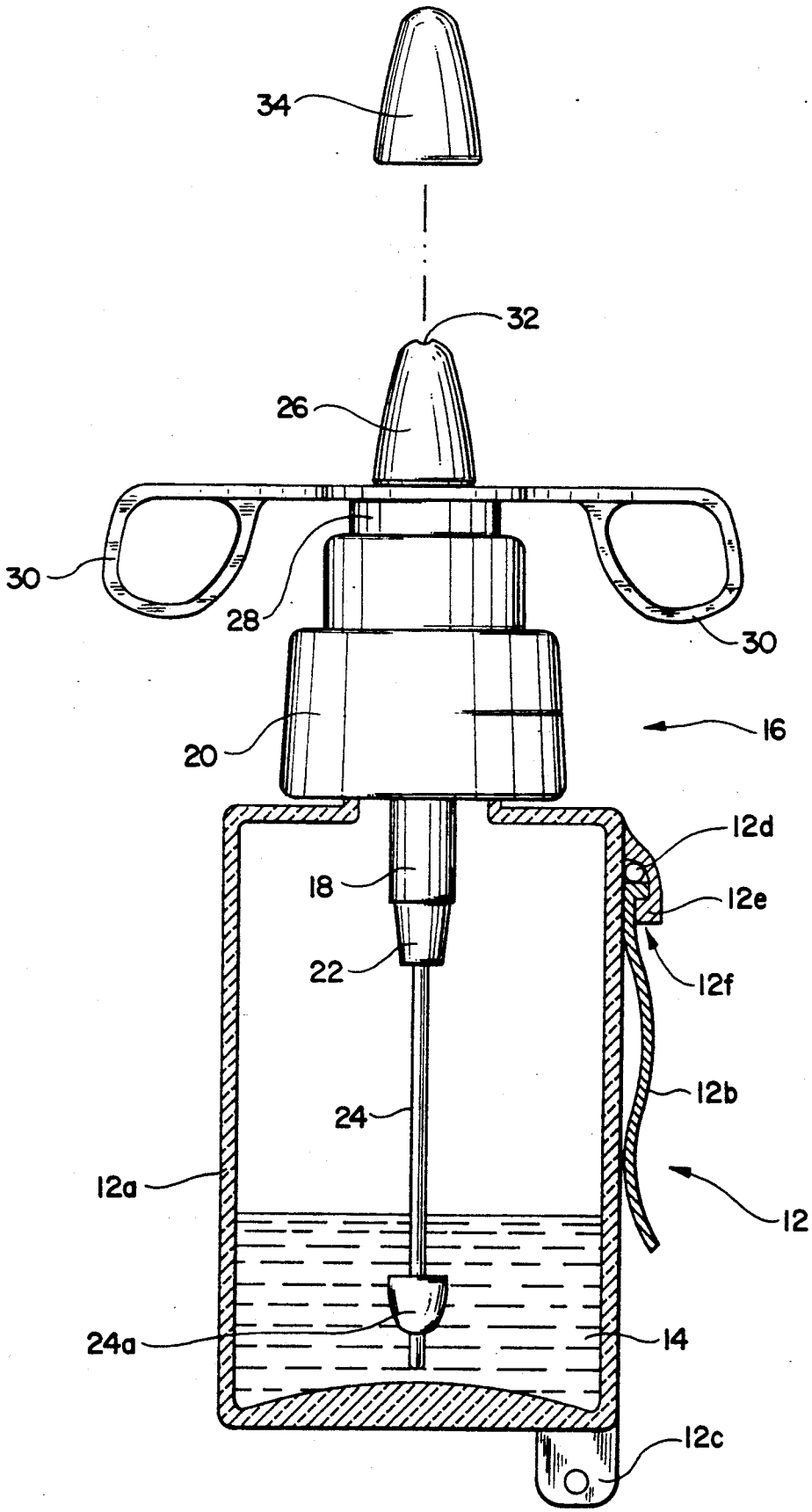
FIG. 2 is a side elevational view of the marker of FIG. 1, the bottle thereof shown partially in cross-sectional detail.

Referring now to FIGS. 1 and 2, the assailant marker of the present invention can be seen from the drawing to include a pump spray bottle 12, and a deterrent fluid 14 disposed within said bottle. Bottle 12 further includes manually activated fluid dispensing means, generally designated 16, enabling discharge of deterrent fluid 14 by an individual for self-defense applications. These elements are generally known in the prior art and do not form a novel portion of the present invention.

Bottle 12 of the present invention assailant marker is formed of a rigid material, such as plastic, having a sufficiently thick wall 12*a* to prevent the collapse thereof when firmly grasped within the hand of the user. Bottle 12 has a threaded, circular opening 13 to which dispensing means 16 may be joined thereby forming a closure for said bottle. Bottle 12 may be provided with securement means, such as clip 12*b* or integral key chain retaining member 12*c*. Clip 12*b*, comprised in the preferred embodiment of sinuously shaped metal and having its long axis substantially parallel to the bottle wall 12*a*, permits the inventive device to be affixed to an article of clothing, a pocket or belt being two of several convenient attachment locations, and key chain retaining member 12*c*, comprising a vertically oriented tab extending from the bottom of bottle 12 and having a hole therein, permits the device to be conveniently attached to a key chain or key ring. Additionally, as retaining member 12*c* is molded from the same rigid material as bottle 12 and is elevated above the bottom of the bottle 12, it may be utilized as a weapon if the user determines that striking a bodily blow at an assailant is necessary. A hole 12*d* in integral clip mounting bracket 12*e*, having a flanged opening 12*f* for retaining clip 12*b*, provides an additional means for attaching the instant assailant marker to an object or support with a chain or lanyard of sufficient diameter supplied by the user.

Referring again to the figures, the manually activated fluid dispensing means 16 may be viewed. Such means for spraying liquids with small pumps are generally well known and are shown, for example, in U.S. Pat. Nos. 2,011,196 and 2,081,798. These patents are hereby incorporated by reference as disclosing pump mechanisms of a type which may be utilized within the instant assailant marker. It must be noted, however, that other similar pump mechanisms may be used with equal facility for the purposes expressed herein. Broadly, the numeral 18 indicates a cylinder joined to cap 20. The cap 20 is adapted to be secured to a neck of spray bottle 12 with cylinder 18 hanging downwardly within the bottle. The lower end of cylinder 18 is in the form of an inverted tapered cone 22 equipped with a vertical bore to receive flexible tube 24 which projects upwardly into cylinder 18 and has one end terminating in close proximity to the bottom of bottle 12. When bottle 12 is horizontally oriented, tube 24, supplied with a weight 24*a* at its lower end, is capable of being bent or flexed under the influence of gravity to reach spray bottle wall 12*a*. In this manner, the lower or intake end of tube 24 will always be submerged in deterrent fluid 14 thereby permitting the maximum efficiency of the device regardless of its orientation during use. A combined spray nozzle and piston 26 is mounted for reciprocation within cylinder 18. A check valve, not shown in the figures, operates within combined spray nozzle and piston 26 preventing fluid therein from returning to bottle 12. Combined spray nozzle and piston 26 is in the form of a sleeve 28 having a sliding fit with cylinder 18 and has joined thereto finger retaining loops 30. Retaining loops 30 are positioned 180 degrees opposite one another and are positioned upon opposing sides of combined spray nozzle and piston 26. Each of said loops 30 are adapted to comfortably receive one finger from the hand of the user.

Nozzle 32 is formed in uppermost portion of combined spray nozzle and piston 26 and communicates with the interior thereof. The port in the spray nozzle 32 is comparatively small so that during outward movement of the sleeve 28, sufficient suction will be developed therein to lift fluid 14 into said sleeve 28 from bottle 12. In the preferred embodiment of the invention, nozzle 32 is adapted to produce a fine mist or spray when delivering deterrent fluid 14 therefrom along an axis vertically oriented through the inventive marking device. This spray is capable of marking an assailant at a range of 3 to 6 feet (1 to 2 meters). The user of the inventive marker is thereby permitted to direct the fluid spray into the facial area or torso of the assailant simultaneously covering a wide area therewith. Since the device is designed to be utilized with the target within close range, deflection of the fluid spray by winds of moderate velocity have been found to be inconsequential in aiming the device and hitting the target. Nevertheless, it is envisioned that nozzle 32 may be adapted to deliver fluids in the form of a continuous and coherent stream. U.S. Pat. No. 4,728,037, for example, discloses nozzle port dimensions suitable for discharging such a stream.

In operation, deterrent fluid 14 is delivered by a reciprocated movement of the combined spray nozzle and piston 26. This action is initiated by first positioning two adjacent fingers of one hand into each of the two finger retaining loops 30. Next, with the flat lowermost portion of bottle 12 supported against the palm of the same hand, combined spray nozzle and piston 26 is reciprocated by the application of force to loops 30. During an outward movement of combined spray nozzle and piston 26 with respect to the cylinder 18, deterrent fluid within spray bottle 12 is drawn into sleeve 28 by way of flexible tube 24, the valve therein acting to prevent return of said fluid to bottle 12 so that on the inward movement of combined spray nozzle and piston 26, the fluid trapped therein will be forced outwardly by way of nozzle 32 in spray form.

The instant assailant marking device further includes a cover 34 which is removably mounted upon the nozzle and formed to prevent the inadvertent expulsion of deterrent fluid 14 while the device is being stored. Cover 34 is held upon combined spray nozzle and piston 26 by friction; however, a mated shoulder and rib combination may also be utilized to positively retain cover 34 upon combined nozzle and piston 26. As may be seen in FIGS. 1 and 2, cover 34 may be removed from combined nozzle and piston 26. To perform this action, the thumb of one hand of the user will engage the side of cover 34, pushing such forward, while the same hand grasps spray bottle 12.

An important characteristic of the instant assailant marker is the deterrent fluid's non-toxic but effective nature. The prior art discloses devices utilizing deterrent fluids which include a lachrymal agent, an odor agent, a dye, and sometimes a combination of one or more of these compounds. Such prior art fluids, however, have been discovered to lack effectiveness or be toxic. Additionally, it is believed that the addition of lachrymal or odor agents to the fluid may lead to an escalating encounter if improperly utilized against an assailant.

U.S. Pat. No. 4,728,037, however, describes a liquid deterrent mixture having food-grade dye compounds, among other agents, therein. Testing of fluid mixtures having the concentration of dye compounds disclosed by this particular patent reference has revealed that while a generally red color is obtained by the fluid mixture, when such is discharged upon a flesh-toned target the coloring agents are so dilute that their intended purpose is thwarted. The instant deterrent fluid has a much greater concentration of dyes—ranging from approximately 2 to 10 the amounts disclosed by the prior art.

The deterrent fluid mixture of the present invention includes only a food grade dye and necessary preservative agents. The dye consists of a mixture of Red Dye No. 3 and Red Dye No. 40. Under ordinary light, Red Dye No. 3 exhibits what may be described as a "rose red" color while Red Dye No. 40 exhibits a "blood red" hue. The advantage of utilizing a mixture of Red Dye No. 3 and Red Dye No. 40 has been documented. The resultant mixture has a color approximating the color of blood offering a psychological distraction to an assailant in addition to marking him for later detection. Red Dye Nos. 3 and 40 are safe and are numbered in accordance with well-known Food, Drug and Cosmetic standards.

Deterrent fluid mixture 14 is preferably formed with the following formulation:

| Agent | Percent by Weight |
|---|---|
| Water | 78.9–93.95 |
| Propylene Glycol | 5–15 |
| FD & C Red No. 40 | 0.5–3 |
| FD & C Red No. 3 | 0.5–3 |
| Propyl Paraben | 0.05–0.1 |

The preservative most suitable for use in deterrent fluid mixture 14 is propyl paraben. Propyl paraben acts to prevent mold and bacterial growth within the fluid as such are capable of rapidly decaying the dye agents. Propylene glycol, on the other hand, has a similar preservative effect but has been added benefit in that it acts as a stabilizer to resist temperature extremes.

It is to be understood that the present invention is not limited to the sole embodiment described above, but encompasses any and all embodiments within the scope of the following claims.

I claim:

1. An assailant marker for spraying a liquid mixture upon a potential assailant, comprising:

a bottle formed of a rigid material and having a threaded circular opening therein, said bottle configured to fit within the palm of the hand;

manually activated fluid dispensing means for dispensing the contents of said bottle in spray form when activated by reciprocatory movement thereof, said dispensing means including:

a cap fitted upon said threaded circular opening;

a cylinder joined to said cap and hanging downwardly within said bottle, the lower end of said cylinder forming an inverted tapered cone and having a vertical bore therein;

a flexible tube having two ends, one end thereof fitted within said bore and the other terminating in close proximity to the bottom of said bottle;

a weight fitted to the lower end of said tube;

a combined spray nozzle and piston having a sliding fit within said cylinder and extending vertically thereof; and at least one finger retaining loop positioned upon said combined spray nozzle and piston to receive at least one finger from the hand of the user;

a deterrent fluid disposed within said bottle;

a clip positioned against an exterior surface of said bottle for affixing said assailant marker to an article of clothing, said clip comprised of metal having a sinuous shape; and an integral clip mounting bracket for joining said clip to said bottle, said bracket projecting from the top of said bottle and having a flanged opening for retaining said clip, said bracket further including a hole to receive a chain or lanyard for attachment of said assailant marker to a remote support.

2. The assailant marker according to claim 1 further including:

two said finger retaining loops, each of said loops being positioned 180 degrees opposite one another.

3. The assailant marker according to claim 1 wherein said bottle further includes:

an integral key chain retaining member projecting from the bottom of said bottle, said retaining member being vertically oriented and having a single hole therein enabling the attachment of said marker to a key chain.

4. The assailant marker according to claim 1 wherein said deterrent fluid comprises:

water ranging from 78.9 to 93.95 percent by weight;

propylene glycol ranging from 5 to 15 percent by weight;

FD & C Red No. 40 ranging from 0.5 to 3 percent by weight;

FD & C Red No. 3 ranging from 0.5 to 3 percent by weight; and propyl paraben ranging from 0.05 to 0.1 percent by weight, wherein FD & C Red No. 40 and FD & C Red No. 3 are present in substantially equal amounts.

5. An assailant marker for spraying a liquid dye mixture upon a potential assailant, comprising:

a bottle formed of a rigid material and having a threaded circular opening therein, said bottle adapted to fit within the palm of the hand, said bottle including:

an integral key chain retaining member projecting from the bottom of said bottle, said retaining member being vertically oriented and having a single hole therein adapted to permit the attachment of said marker to a key chain;

a clip positioned against the exterior surface of said bottle for affixing said marker to an article of clothing, said clip comprised of metal having a sinuous shape; and an integral clip mounting bracket for joining said clip to said bottle, said bracket projecting from the top of said bottle and having a flanged opening for retaining said clip, said bracket further including a hole adapted to receive a chain or lanyard for attachment of said marker to a remote support;

manually activated fluid dispensing means for dispensing the contents of said bottle in spray form when activated by reciprocatory movement thereof, said dispensing means including:

a cap fitted upon said threaded circular opening;

a cylinder joined to said cap and hanging downwardly within said bottle, the lower end of said cylinder forming an inverted tapered cone and having a vertical bore therein;

a flexible tube having two ends, one end thereof fitted within said bore and the other terminating in close proximity to the bottom of said bottle;

a weight fitted to the lower end of said tube;

a combined spray nozzle and piston having a sliding fit within said cylinder and extending vertically upward therefrom; and two finger retaining loops positioned 180 degrees opposite one another upon said combined spray nozzle and piston, each said loop adapted to receive one finger from the hand of the user; and a deterrent fluid disposed within said bottle consisting of:

water ranging from 78.9 to 93.95 percent by weight;

propylene glycol ranging from 5 to 15 percent by weight;

FD & C Red No. 40 ranging from 0.5 to 3 percent by weight;

FD & C Red No. 3 ranging from 0.5 to 3 percent by weight; and, propyl paraben ranging from 0.05 to 0.1 percent by weight, wherein FD & C Red No. 40 and FD & C Red No. 3 are present in substantially equal amounts.

* * * * *